US009532147B2

(12) United States Patent
Scheller

(10) Patent No.: US 9,532,147 B2
(45) Date of Patent: Dec. 27, 2016

(54) SYSTEM FOR DETECTION OF SPECIAL ENVIRONMENTS FOR HEARING ASSISTANCE DEVICES

(71) Applicant: Starkey Laboratories, Inc., Eden Prairie, MN (US)

(72) Inventor: Thomas A. Scheller, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/946,851

(22) Filed: Jul. 19, 2013

(65) Prior Publication Data

US 2015/0023536 A1 Jan. 22, 2015

(51) Int. Cl.
*H04R 25/00* (2006.01)

(52) U.S. Cl.
CPC ..... *H04R 25/30* (2013.01); *H04R 25/554* (2013.01); *H04R 25/70* (2013.01); *H04R 2225/41* (2013.01)

(58) Field of Classification Search
CPC ..... H04R 25/50; H04R 25/554; H04R 25/558; H04R 2225/39; H04R 2225/41; H04R 2225/55; H04R 2460/07; H04R 25/507
USPC ..... 381/312–331
See application file for complete search history.

(56) References Cited

U.S. PATENT DOCUMENTS 4,777,474 A 10/1988 Clayton
6,195,572 B1 2/2001 Patterson et al.
6,870,940 B2 3/2005 Meyer et al.
7,853,030 B2 12/2010 Grasbon et al.
8,705,782 B2 4/2014 Woods et al.
8,867,765 B2 10/2014 Solum
2003/0064746 A1 4/2003 Rader et al.
2003/0235319 A1 12/2003 Rass
2004/0138723 A1 7/2004 Malick et al.
2006/0222194 A1 10/2006 Bramslow
(Continued)

FOREIGN PATENT DOCUMENTS

DK 2104378 T3 7/2013
EP 2521377 A1 11/2012
(Continued)

OTHER PUBLICATIONS

"U.S. Appl. No. 12/388,341 , Response filed Nov. 13, 2013 to Final Office Action mailed Aug. 13, 2013 and Advisory Action mailed Oct. 30, 2013", 11 pgs.
(Continued)

*Primary Examiner* — Matthew Eason
(74) *Attorney, Agent, or Firm* — Schwegman Lundberg & Woessner, P.A.

(57) ABSTRACT

Disclosed herein, among other things, are systems and methods for detection of special environments for hearing assistance devices. One aspect of the present subject matter includes a method of operating a hearing assistance device for a user. A signal is received from a mobile device, such as a cellular telephone, representative of an environmental parameter sensed by the mobile device. In various embodiments, an acoustic environment about the mobile device is identified based on the received signal using a signal processor. An operational mode of the hearing assistance device is adjusted using the signal processor based on the identified acoustic environment, according to various embodiments.

20 Claims, 7 Drawing Sheets

(56) References Cited

U.S. PATENT DOCUMENTS

| | | | | |
|---|---|---|---|---|
| 2007/0237335 | A1 | 10/2007 | O'sullivan | |
| 2007/0249289 | A1 | 10/2007 | Grafenberg et al. | |
| 2008/0013769 | A1 | 1/2008 | Sacha et al. | |
| 2008/0199971 | A1 | 8/2008 | Tondra | |
| 2009/0097683 | A1* | 4/2009 | Burns et al. | 381/324 |
| 2009/0184706 | A1 | 7/2009 | Duric et al. | |
| 2009/0196444 | A1 | 8/2009 | Solum | |
| 2009/0208043 | A1 | 8/2009 | Woods et al. | |
| 2010/0208631 | A1 | 8/2010 | Zhang et al. | |
| 2011/0293123 | A1* | 12/2011 | Neumeyer et al. | 381/314 |
| 2012/0235633 | A1 | 9/2012 | Kesler et al. | |
| 2015/0003652 | A1* | 1/2015 | Bisgaard | H04R 25/50 381/314 |
| 2015/0023537 | A1 | 1/2015 | Woods et al. | |

FOREIGN PATENT DOCUMENTS

| | | | |
|---|---|---|---|
| EP | 2104378 | B1 | 7/2013 |
| WO | WO-2007046748 | A1 | 4/2007 |
| WO | WO-2008055960 | A1 | 5/2008 |

OTHER PUBLICATIONS

"U.S. Appl. No. 12/388,341, Advisory Action mailed Feb. 22, 2012", 2 pgs.
"U.S. Appl. No. 12/388,341, Advisory Action mailed Oct. 30, 2013", 3 pgs.
"U.S. Appl. No. 12/388,341, Final Office Action mailed Aug. 13, 2013", 18 pgs.
"U.S. Appl. No. 12/388,341, Final Office Action mailed Sep. 19, 2012", 18 pgs.
"U.S. Appl. No. 12/388,341, Final Office Action mailed Dec. 9, 2011", 14 pgs.
"U.S. Appl. No. 12/388,341, Non Final Office Action mailed Feb. 14, 2013", 16 pgs.
"U.S. Appl. No. 12/388,341, Non Final Office Action mailed Apr. 10, 2012", 17 pgs.
"U.S. Appl. No. 12/388,341, Non Final Office Action mailed Jun. 17, 2011", 11 pgs.
"U.S. Appl. No. 12/388,341, Notice of Allowance mailed Nov. 22, 2013", 9 pgs.
"U.S. Appl. No. 12/388,341, Response filed Jan. 22, 2013 to Final Office Action mailed Sep. 19, 2012", 10 pgs.
"U.S. Appl. No. 12/388,341, Response filed Feb. 9, 2012 to Final Office Action mailed Dec. 9, 2011", 9 pgs.
"U.S. Appl. No. 12/388,341, Response filed Mar. 9, 2012 to Advisory Action mailed Feb. 22, 2012", 11 pgs.
"U.S. Appl. No. 12/388,341, Response filed May 14, 2013 to Non Final Office Action mailed Feb. 14, 2013", 10 pgs.
"U.S. Appl. No. 12/388,341, Response filed Sep. 10, 2012 to Non Final Office Action mailed Apr. 10, 2012", 10 pgs.
"U.S. Appl. No. 12/388,341, Response filed Sep. 19, 2011 to Non Final Office Action mailed Jun. 17, 2011", 9 pgs.
"U.S. Appl. No. 12/388,341, Response filed Oct. 14, 2013 to Final Office Action mailed Aug. 13, 2013", 11 pgs.
"European Application Serial No. 09250424.0, European Search Report Jun. 4, 2009", 8 pgs.
"European Application Serial No. 09250424.0, Examination Notification mailed Feb. 8, 2011", 8 pgs.
"European Application Serial No. 09250424.0, Response filed Jun. 16, 2011 to Examination Notification mailed Feb. 8, 2011", 12 pgs.
"European Application Serial No. 09250424.0, Response filed Dec. 9, 2009 to European Search Report mailed Jun. 4, 2009", 6 pgs.
Tondra, Mark, "Flow Assay With Integrated Detector", U.S. Appl. No. 60/887,609, filed Feb. 1, 2007, 28 pgs.
"European Application Serial No. 14177458.8, Extended European Search Report mailed Jan. 9, 2015", 7 pgs.
"U.S. Appl. No. 14/186,754, Non Final Office Action mailed Jul. 23, 2015", 6 pgs.
"European Application Serial No. 14177458.8, Extended European Search Report mailed Jan. 22, 2015".
"U.S. Appl. No. 14/186,754, Advisory Action mailed Apr. 7, 2016", 3 pgs.
"U.S. Appl. No. 14/186,754, Final Office Action mailed Jan. 12, 2016", 11 pgs.
"U.S. Appl. No. 14/186,754, filed Mar. 14, 2016 to Final Office Action mailed Jan. 12, 2016", 7 pgs.
"U.S. Appl. No. 14/186,754, filed Oct. 22, 2015 to Non Final Office Action mailed Jul. 23, 2015", 6 pgs.
"European Application Serial No. 14177458.8, Communication pursuant to Rules 70(2) and 70a(2) mailed Feb. 12, 2015", 4 pgs.
"European Application Serial No. 14177458.8, filed Jul. 23, 2015 to Communication pursuant to Rules 70(2) and 70a(2) mailed Feb. 12, 2015", 9 pgs.

* cited by examiner

| 510 | 520 | |
|---|---|---|
| 512 CODE 1 | ACOUSTIC ENVIRONMENT 1<br>E.G. INSIDE A CAR | 522 |
| 514 CODE 2 | ACOUSTIC ENVIRONMENT 2<br>E.G. IN A ROOM WHILE VACUUMING | 524 |
| 516 CODE 3 | ACOUSTIC ENVIRONMENT 3<br>E.G. IN AN OPEN SPACE | 526 |
| ⋮ | ⋮ | |
| 518 CODE N | ACOUSTIC ENVIRONMENT N<br>E.G. IN A LECTURE HALL | 528 |

*Fig. 5*

SYSTEM FOR DETECTION OF SPECIAL ENVIRONMENTS FOR HEARING ASSISTANCE DEVICES

RELATED APPLICATIONS

This application is related to U.S. Provisional Patent Application Ser. No. 61/029,564, filed Feb. 19, 2008, which is incorporated herein by reference in its entirety. This application is also related to U.S. patent application Ser. No. 12/388,341, filed Feb. 18, 2009, which is incorporated herein by reference in its entirety.

TECHNICAL FIELD

This document relates generally to hearing assistance systems and more particularly to methods and apparatus for detection of special environments for hearing assistance devices.

BACKGROUND

Hearing assistance devices, such as hearing aids, can provide adjustable operational modes or characteristics that improve the performance of the hearing assistance device for a specific person or in a specific environment. Some of the operational characteristics include, but are not limited to volume control, tone control, directionality, and selective signal input. These and other operational characteristics can be programmed into a hearing aid. Advanced hearing assistance devices, such as digital hearing aids, may be programmed to change from one operational mode or characteristic to another depending on algorithms operating on the device. As the person wearing a hearing assistance device moves between different acoustic environments, it may be advantageous to change the operational modes or characteristics of the hearing assistance device to adjust the device to particular acoustic environments. Some devices may possess signal processing adapted to classify the acoustic environments in which the hearing assistance device operates. However, such signal processing may require a relatively large amount of signal processing power, be prone to error, and may not yield sufficient improvement in cases when processing power is available. Certain environments may be more difficult to classify than others and can result in misclassification of the environment or frequent switching of the adapted behavior to the detected environment, thereby resulting in reduced hearing benefits of the hearing assistance device. One problematic environment is that of a vehicle, such as an automobile. Wearers of digital hearing aids in moving vehicles are exposed to a variety of sounds coming from the vehicle, open windows, fans, and sounds from outside of the vehicle. Users may experience frequent mode switching from adaptive devices as they attempt to adjust rapidly to changing acoustic environmental inputs.

There is a need in the art for an improved system for determining acoustic environments in hearing assistance devices.

SUMMARY

Disclosed herein, among other things, are systems and methods for detection of special environments for hearing assistance devices. One aspect of the present subject matter includes a method of operating a hearing assistance device for a user. A signal is received from a mobile device, such as a cellular telephone, representative of an environmental parameter sensed by the mobile device. In various embodiments, an acoustic environment about the mobile device is identified based on the received signal using a signal processor. An operational mode of the hearing assistance device is adjusted using the signal processor based on the identified acoustic environment, according to various embodiments.

One aspect of the present subject matter includes a hearing assistance system including a hearing assistance device for a user. The system includes a wireless receiver configured to receive a signal from mobile device, such as a cellular telephone, including a representation of a sensed parameter related to an acoustic environment about the mobile device. According to various embodiments, the system also includes a processor configured to identify the acoustic environment using the received signal and to adjust a hearing assistance device parameter based the identified environment.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 5 illustrates a table showing various acoustic environment codes, according to one embodiment of the present subject matter.

DETAILED DESCRIPTION

Figure 1:
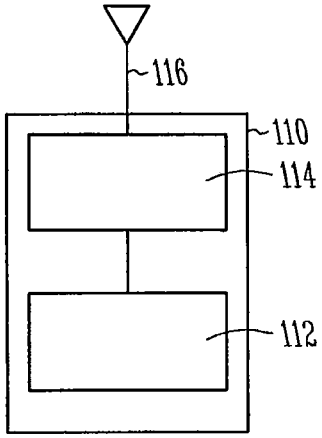
FIG. 1 illustrates a block diagram of a wireless beacon device according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

As a person wearing a hearing assistance device moves between different acoustic environments, it may be advantageous to change the operational modes or characteristics of the hearing assistance device to adjust the device to particular acoustic environments. Certain environments may be more difficult to identify than others and can result in misidentification of the environment. One problematic environment is that of a vehicle, such as an automobile. Wearers of digital hearing aids in moving vehicles are exposed to a variety of sounds coming from the vehicle, open windows, fans, and sounds from outside of the vehicle.

Disclosed herein, among other things, are systems and methods for detection of special environments for hearing assistance devices. One aspect of the present subject matter includes a hearing assistance system including a hearing assistance device for a user. The system includes a wireless receiver configured to receive a signal from mobile device, such as a cellular telephone, including a representation of a sensed parameter related to an acoustic environment about the mobile device. According to various embodiments, the system also includes a processor configured to identify the acoustic environment using the received signal and to adjust a hearing assistance device parameter based the identified environment.

The present subject matter provides a system and method for identifying acoustic environments using a mobile device. Examples of mobile devices include cellular telephones such as iPhones, Android phones, and Blackberry phones. Other types of mobile devices used include, but are not limited to: car global positioning system (GPS) systems, iPods, personal digital assistants (PDAs), and beacon devices. One environment detected by the present system includes an inside of a car. Identifying the car environment is useful, since many hearing aid adaptive features should operate differently in a car. For example, if the car environment is identified, then directionality should be set to omni-directional rather than directional mode. In one embodiment, for an iPhone enabled hearing aid, the accelerometer and the GPS system of the iPhone can be used to distinguish that the car is moving. At greater than 5 mph (for example), the iPhone sends a signal to the hearing aid that it is now in a moving vehicle, in an embodiment. Other parameters can be sensed by the mobile device to assist in identifying the acoustic environment about the mobile device, without departing from the scope of the present subject matter. In various embodiments, the hearing aid assumes that this vehicle is a car, and activates or adjusts adaptive features for the car.

Prior adjustment techniques did not reliably classify the car environment, leading to adaptive behavior that is not appropriate for the car. For example, directional switching was based on level and signal to noise ratio (SNR). In a car, this leads to frequent false switching. Switching to directional mode in a car is almost always wrong. The car is both a unique and common environment for hearing aid wearers. By correctly classifying the car environment using the present subject matter, the hearing aid can adapt appropriately to this unique environment, with its unique requirements (noisy, but constant LF noise; not facing the talker, etc). The present subject matter classifies the car environment reliably and provides that information to the hearing aid signal processor. Using movement of a mobile device, such as a cellular phone, the present subject matter reliably differentiates the car environment. Other acoustic environments are also similarly classified: train, taxi, limo, bike, and airplane. In one embodiment, each of these similar environments is classified as a car, with the same or similar adaptive behavior. In other embodiments, the system can further differentiate between car and bike, for example. The present subject matter improves hearing aid performance in a car, which is a common acoustic environment.

Figure 7:
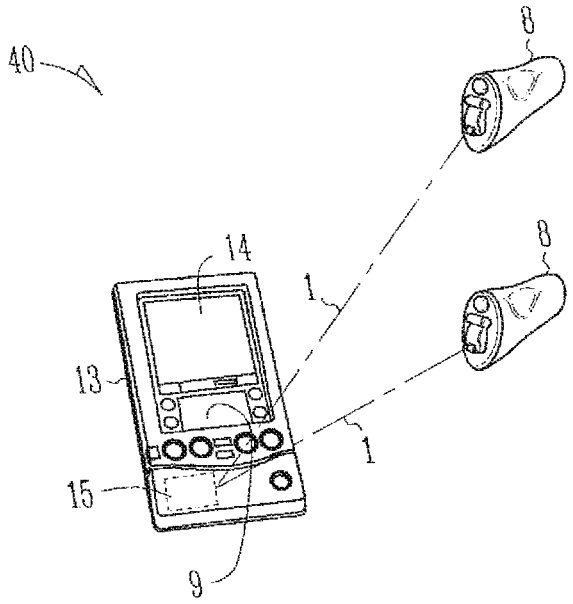
FIG. 7 illustrates a pictorial diagram of a system for detection of special environments for hearing assistance devices, according to various embodiments of the present subject matter.

FIG. 7 illustrates a block diagram of a system 40 for detection of special environments for hearing assistance devices, according to various embodiments of the present subject matter. A mobile device 13 has internal sensing electronics 15 which are native to the mobile device 13, in an embodiment. Communications 1 between mobile device 13 and hearing aids 8 may be conducted over wired, wireless or combinations of wired and wireless connections. Mobile device 13 is shown as a cellular phone, however, it is understood that mobile device 13 may be any variety of mobile computer, including, but not limited to, a global positioning system (GPS), a personal digital assistant (PDA), an IPOD, or other type of handheld computer as may be developed in the future. It is further understood that hearing aids 8 are shown as completely-in-the-canal (CIC) hearing aids, but that any type of devices, including but not limited to, in-the-ear (ITE), behind-the-ear (BTE), receiver-in-the-canal (RIC), cochlear implants, headphones, and hearing assistance devices generally as may be developed in the future may be used without departing from the scope of the present subject matter. It is further understood that a single hearing aid may be adjusted and thus, the present subject matter is not limited to dual hearing aid applications. Mobile device 13 is shown as having a screen 14. The screen 14 is demonstrated as a liquid crystal display (LCD), but it is understood that any type of screen may be used without departing from the scope of the present subject matter. Mobile device 13 also has various input devices 9, including buttons and/or a touchpad; however, it is understood that any input device, including, but not limited to, a joystick, a trackball, or other input device may be used without departing from the present subject matter. An input interface facilitates input from users of the system. Inputs include, but are not limited to, pointer device, touch, voice, gesture, and keyboard inputs.

FIG. 1 illustrates a wireless beacon device 110, such as mobile device 13 in FIG. 7, according to one embodiment of the present subject matter. The illustrated beacon device 110 includes a memory 112, a transmitter 114 and an antenna 116. In the illustrated embodiment, the memory 112 and antenna 116 are coupled to transmitter 114. In various embodiments, one or more conductors are used as an antenna 116 for electronic wireless communications. When driven by the transmitter 114, the antenna 116 converts electrical signals into electromagnetic energy and radiates electromagnetic waves for reception by other devices. In various embodiments, the antenna 166 is implemented in different configurations. In one embodiment, antenna 166 is a monopole. In one embodiment, antenna 166 is a dipole. In one embodiment, antenna 166 is a patch antenna. In one embodiment, antenna 166 is a flex antenna. In one embodiment, antenna 166 is a loop antenna. In one embodiment, antenna 166 is a waveguide antenna. In various embodiments, the wireless beacon device 110 includes a processor. In various embodiments the processor is a microprocessor. In various embodiments the processor is a digital signal processor. In various embodiments the processor is microcontroller. Other processors may be used without departing from the scope of the present subject matter. Other antenna configurations are possible without departing from the scope of the present subject matter.

In various embodiments, the beacon device includes one or more sensors. In one embodiment, the sensor is an accelerometer. In one embodiment, the sensor is a microelectro-mechanical system (MEMS) accelerometer. In one embodiment, the sensor is a magnetic sensor. In one embodiment, the sensor is a giant magnetorestrictive (GMR) sensor. In one embodiment the sensor is an anisotropic magnetorestrictive (AMR) sensor. In one embodiment the sensor is a microphone. In various embodiments, a combination of sensors are employed, including, but not limited to those stated in this disclosure. In various embodiments signal processing circuits capable of processing the sensor outputs are included. In various embodiments, a processor is included which processes signals from the one or more sensors. In various embodiments, the processor is adapted to determine the acoustic environment based on data from at least one of the one or more sensors. In such embodiments, environment information is sent wirelessly to one or more hearing assistance devices. In various embodiments, the beacon device sends the sensor data wirelessly. In such embodiments, one or more hearing assistance devices can receive the data and process it to identify an acoustic environment. In various embodiments, the beacon may act as a remote sensor to the one or more hearing assistance devices. The information from the beacon can be used exclusively, selectively, or in combination with audio information from the hearing assistance device to determine an acoustic environment. Other sensors and applications are possible without departing from the scope of the present subject matter.

In various embodiments, memory 112 stores one or more acoustic environment codes that identify one or more particular acoustic environments. Transmitter 114 is configured to transmit the one or more acoustic environment codes stored in memory 112 at uniform intervals. In one embodiment, the transmitter 114 is adapted to detect the presence of a hearing assistance device and initiate transmission of one or more acoustic environment codes stored in memory 112. In various embodiments, memory 112 includes non-volatile flash memory. In various embodiments, memory 112 includes a DRAM (Dynamic Random Access Memory). In various embodiments, memory 112 includes an SRAM (Static Random Access Memory). In various embodiments, memory 112 stores sensor signal information from one or more sensors. In various embodiments, such sensor signal information is telemetered using transmitter 114. In various embodiments, such sensor signal information is processed before it is transmitted. Other techniques and apparatus may be employed to provide the memory. For example, in one embodiment, the code is hardwired to provide the memory used by transmitter 114.

In various embodiments, beacon device 110 is attached to devices to assist the hearing assistance device in determining the appropriate processing required by the hearing assistance device. For example, a beacon device 110 could be attached to a user's television, and the hearing assistance device would automatically switch to a "television" mode when the television is powered on (thus activating the TV beacon). In various embodiments, the hearing assistance device switches to a predetermined mode when it senses various coded beacon devices in range. In various embodiments, beacon devices could be attached to noisy consumer devices such as a vacuum cleaner, which can change noise reduction more accurately and quickly then when compared to having to detect such consumer devices solely based on their acoustic signature. In various embodiments, beacon devices could be configured to automatically terminate transmission of acoustic environment codes when the consumer device (such as a television, vacuum cleaner, etc.) is turned off.

Figure 2:
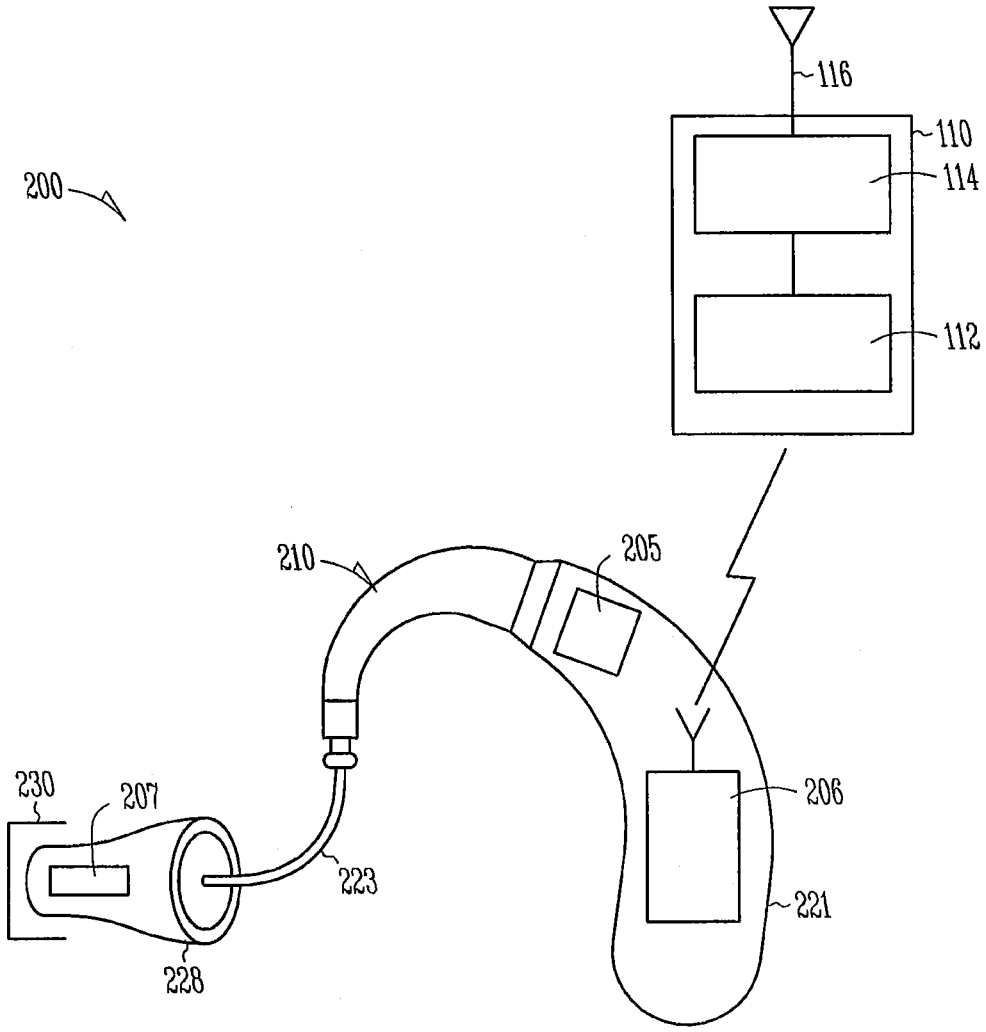
FIG. 2 illustrates a wireless beacon system, according to one embodiment of the present subject matter.

FIG. 2 illustrates a wireless beacon system 200, according to one embodiment of the present subject matter. FIG. 2 demonstrates one embodiment with a receiver in the canal (RIC) design, it is understood that other types of hearing assistance devices may be employed without departing from the scope of the present subject matter. The illustrated system 200 shows the beacon device 110 in wireless communication with a hearing assistance device 210. In various embodiments, the hearing assistance device 210 includes a first housing 221, a second housing 228 and a cable assembly 223 that includes conductors, which connect electrical components such as hearing assistance electronics 205 enclosed in the first housing 221 to electrical components such as speaker (also known as a "receiver" as used in hearing aid parlance) 207 enclosed within second housing 228. In one embodiment, first housing 221 includes signal processing electronics in communication with the wireless receiver 206 to perform various signal processing depending on one or more beacon signals detected by wireless receiver 206. In various embodiments, at least one of the first housing 221 and the second housing 228 includes at least one microphone to capture the acoustic waves that travel towards a user's ears. In the illustrated embodiment, the first housing 221 is adapted to be worn on or behind the ear of a user and the second housing 228 is adapted to be positioned in an ear canal 230 of the user. In various embodiments, one or more of the conductors in the cable assembly 223 can be used as an antenna for electronic wireless communications. Some examples of such embodiments are found in, but not limited to, U.S. patent application Ser. No. 12/027,151, entitled ANTENNA USED IN CONJUNCTION WITH THE CONDUCTORS FOR AN AUDIO TRANSDUCER, filed Feb. 6, 2008, the entire disclosure of which is incorporated by reference in its entirety. In various embodiments, the cable assembly 223 may include a tube, protective insulation or a tube and protective insulation. In various embodiments, the cable assembly 223 is formable so as to adjust the relative position of the first and second housing according to the comfort and preference of the user.

In various embodiments, such as in behind-the-ear devices, hearing assistance electronics 205 is in communications with a speaker (or receiver, as is used commonly in hearing aids) in communication with electronics in first housing 221. In such embodiments, a hollow sound tube is used to transmit sound from the receiver in the behind-the-ear or over-the-ear device to an earpiece 228 in the ear. Thus, in the BTE application, BTE housing 221 is connected to a sound tube 223 to provide sound from the receiver to a standard or custom earpiece 228. In such BTE designs, no receiver is found in the earpiece 228.

In various embodiments, beacon device 110 transmits an acoustic environment code identifying an acoustic environment. In various embodiments, the wireless receiver 206 in the hearing assistance device 210 receives the acoustic environment codes transmitted by the beacon device 110. In various embodiments, upon receiving the acoustic environment code, the wireless receiver 206 sends the received acoustic environment code to hearing assistance electronics 205. In various embodiments, sensor information is transmitted by the beacon device 110 to hearing assistance device 210 and the information is processed by the hearing assistance device. In various embodiments, the processing includes environment determination. In various embodiments, the information transmitted includes sensor based information. In various embodiments, the information transmitted includes statistical information associated with sensed information.

In various embodiments the hearing assistance electronics 205 can be programmed to perform a variety of functions depending on a received code. Some examples include, but are not limited to, configuring the operational mode of the at least one microphone, adjusting operational parameters, adjusting operational modes, and/or combinations of one or more of the foregoing options. In various embodiments, the operating mode of the microphone is set to directional mode based on the received acoustic environment code that identifies a particular acoustic environment (e.g., acoustic environment where the user is listening to fixed speaker in a closed room), if the wearer would benefit from a directional mode setting for a better quality of hearing. In various embodiments, the operating mode of the microphone is set to an omni-directional mode based on the received acoustic environment code. For example, if the user is listening to natural sounds in an open field, the microphone setting can be set to omni-directional mode for providing further clarity of the acoustic waves received by the hearing assistance device 210. In various embodiments, where there is more than one microphone, the operating mode of a first microphone can be set to a directional mode and the operating mode of a second microphone can be set to an omni-directional mode based on the acoustic environment code received from the beacon device 110.

In various embodiments, where there is more than one microphone, the combination of microphones can be set to a directional mode or an omni-directional mode, or a combination of omni and directional modes, based on the acoustic environment code received from the beacon device 110.

In various embodiments, the first housing 221 is a housing adapted to be worn on the ear of a user, such as, an on-the-ear (OTE) housing or a behind-the-ear (BTE) housing. In various embodiments, the second housing 228 includes an earmold. In various embodiments, the second housing 228 includes an in-the-ear (ITE) housing. In various embodiments, the second housing 228 includes an in-the-canal (ITC) housing. In various embodiments, the second housing 228 includes a completely-in-the-canal (CIC) housing. In various embodiments the second housing 228 includes an earbud. In various embodiments, the receiver 207 is placed in the ear canal of the wearer using a small nonocclusive housing. Other earpieces are possible without departing from the scope of the present subject matter.

Figure 3:
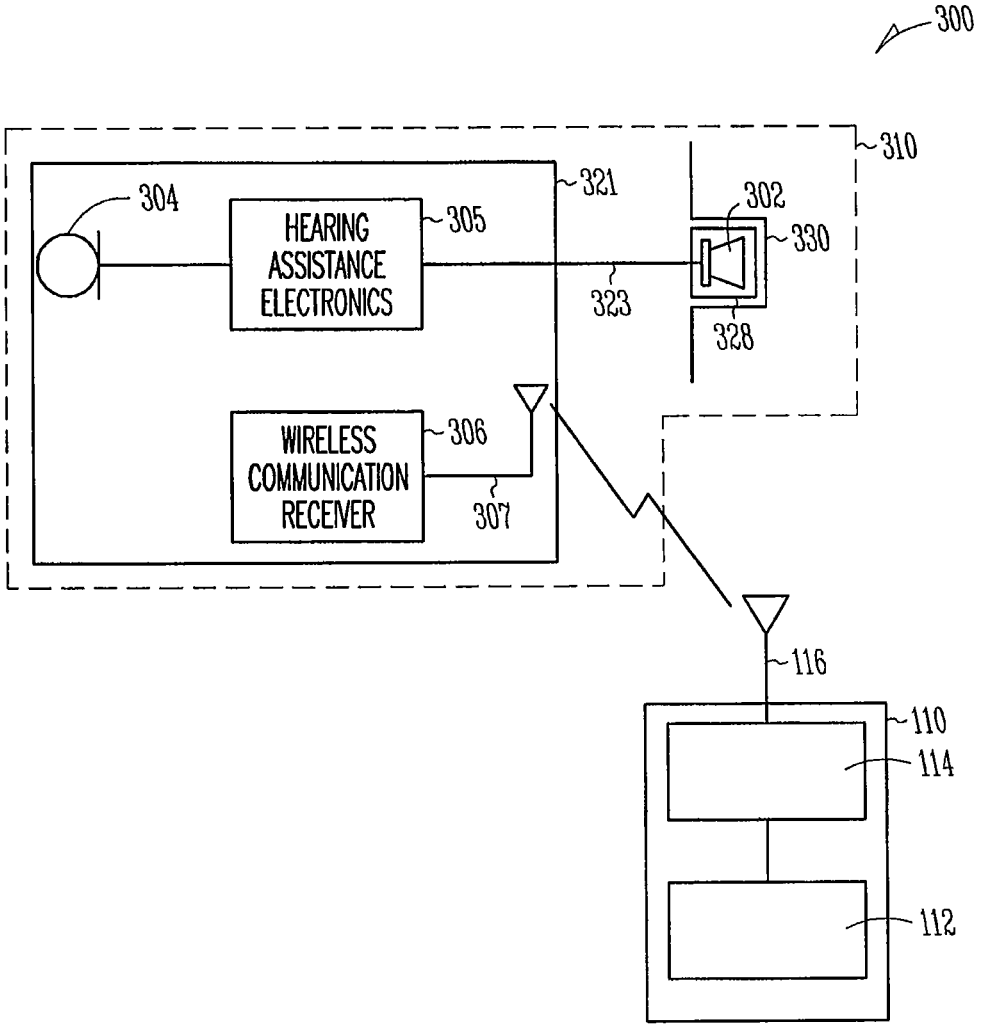
FIG. 3 illustrates a block diagram of a wireless beacon system including a hearing assistance device, according to one embodiment of the present subject matter.

FIG. 3 illustrates a block diagram of a system 300, according to the present subject matter. The illustrated system 300 shows the beacon device 110 in wireless communication with a hearing assistance device 310. In various embodiments, the hearing assistance device 310 includes a first housing 321, an acoustic receiver or speaker 302, positioned in or about the ear canal 330 of a wearer and conductors 323 coupling the receiver 302 to the first housing 321 and the electronics enclosed therein. The electronics enclosed in the first housing 321 includes a microphone 304, hearing assistance electronics 305, a wireless communication receiver 306 and an antenna 307. In various embodiments, the hearing assistance electronics 305 includes at least one processor and memory components. The memory components store program instructions for the at least one processor. The program instructions include functions allowing the processor and other components to process audio received by the microphone 304 and transmit processed audio signals to the speaker 302. The speaker emits the processed audio signal as sound in the user's ear canal. In various embodiments, the hearing assistance electronics includes functionality to amplify, filter, limit, condition or a combination thereof, the sounds received using the microphone 304.

In the illustrated embodiment of FIG. 3, the wireless communications receiver 306 is connected to the hearing assistance electronics 305 and the conductors 323 connect the hearing assistance electronics 305 and the speaker 302. In various embodiments, the hearing assistance electronics 305 includes functionality to process acoustic environment codes or sensor related information received from a beacon device 110 using the antenna 307 that is coupled to the wireless communications receiver 306.

Figure 4:
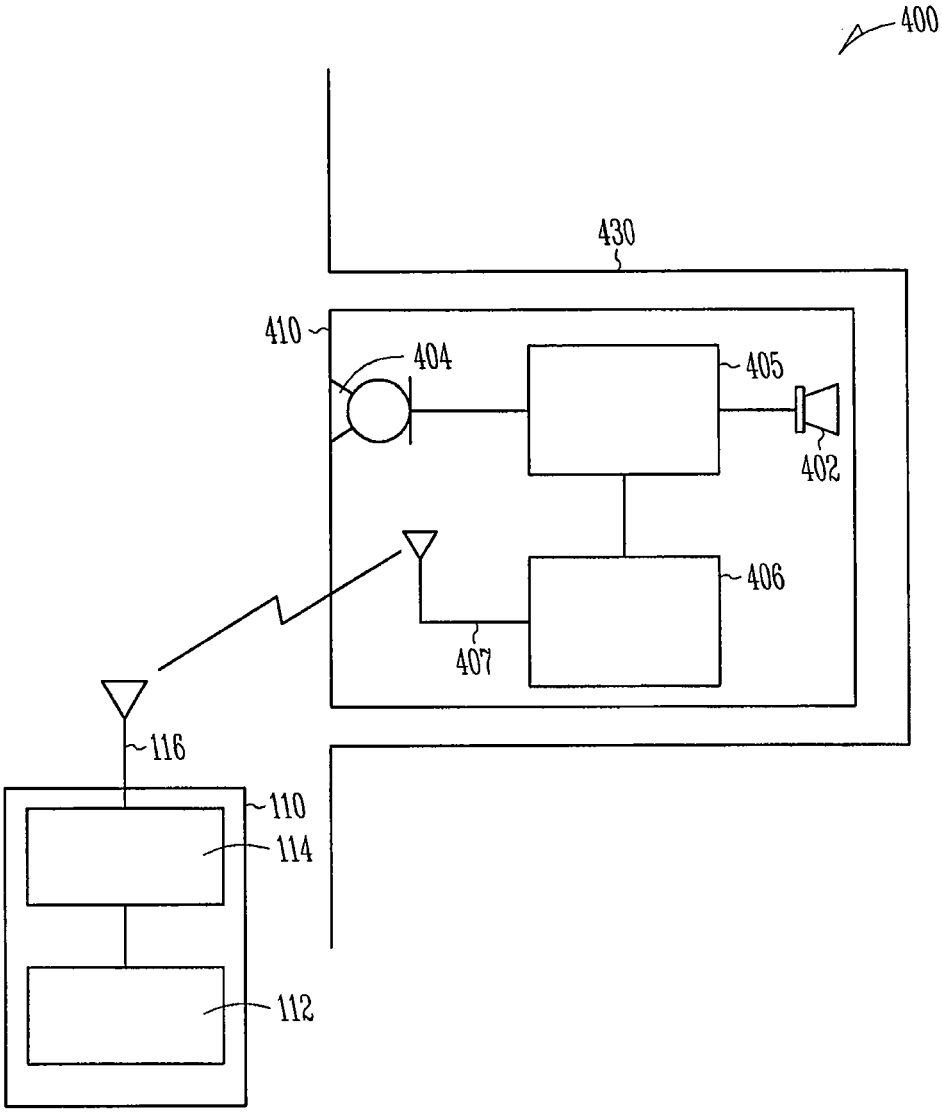
FIG. 4 illustrates a block diagram of a wireless beacon system including a hearing assistance device adapted to work in a user's ear having a wireless communications receiver, according to one embodiment of the present subject matter.

FIG. 4 illustrates a block diagram of a system 400, according to the present subject matter. The illustrated system 400 shows the beacon device 110 in wireless communication with a hearing assistance device 410 placed in or about an ear canal 430. In various embodiments, the hearing assistance device 410 includes a speaker 402, a microphone 404, hearing assistance electronics 405, a wireless communication receiver 406 and antenna 407. It is understood that the hearing assistance device shown in FIG. 4 includes, but is not limited to, a completely-in-the-canal device, and an in-the ear device. Other devices may be in communication with beacon device 10 without departing from the scope of the present subject matter.

FIG. 5 illustrates a table 500 showing various acoustic environment codes, according to the present subject matter. The illustrated table 500 includes columns 510 and 520 representing acoustic environment codes and acoustic environments, respectively. In various embodiments, table 500 includes acoustic environment codes 512, 514, 516 and 518 corresponding respectively to acoustic environments 522, 524, 526 and 528. In various embodiments, acoustic environment codes 512, 514, 516 and 518 includes code 1, code 2, code 3 and code N, respectively. In various embodiments, codes 1-N are digital signals having a pre-determined arrangement of bits that are transmitted either serially or in parallel by beacon device 110 and received by any of hearing assistance devices 210, 310 and 410. In various embodiments, acoustic environment 522 can include the acoustic environment inside a stationary automobile. In various embodiments, acoustic environment 522 can include the acoustic environment inside a moving automobile. In various embodiments, acoustic environment 524 includes the acoustic environment in a room while the wearer of a hearing assistance device is performing a vacuuming function. In various embodiments, acoustic environment 526 includes the acoustic environment of an open space. In various embodiments, acoustic environment 526 includes the acoustic environment experienced by the wearer of a hearing assistance device in a country-side or a busy city street. In various embodiments, acoustic environment 528 includes the acoustic environment experienced by the wearer of a hearing assistance device in a lecture hall. Many other examples of acoustic environments can be represented by alternate codes to provide information to the hearing assistance device as to the particular environment that the hearing assistance device user will experience as the user enters that particular acoustic environment. The use of such acoustic environment codes eliminates the need for complex signal processing methods needed in hearing assistance devices to classify the environment in which the hearing assistance device is operating. In various embodiments, the hearing assistance device reads the acoustic environment code transmitted by the beacon device and accordingly sets the operating modes for the microphones within the hearing assistance device. In various embodiments, the hearing assistance device reads the acoustic environment code transmitted by the beacon device and uses appropriate signal processing methods based on the received acoustic environment code. In various embodiments, the acoustic environment codes/acoustic environment associations are pre-programmed in the hearing assistance device. For example, when detecting a "car" code the hearing assistance device should change its directional processing to assume sound sources of interest are not necessarily straight ahead and therefore can choose an omni-directional mode. In various embodiments, the acoustic environment codes are learned by the hearing assistance device. For example, the hearing assistance device would learn to associate regular user changes to hearing assistance device processing with an acoustic environment code being picked up while those changes are made.

In various embodiments, each of the acoustic environment codes stored in memory 112 is indicative of various different acoustic environments. In various embodiments, the transmitted wireless signals include data indicative of the acoustic environment of the location of beacon device 110. In various embodiments, the acoustic environments include, but are not limited to, the inside of a car, an empty room, a lecture hall, a room with furniture, open spaces such as in a country side, a sidewalk of a typical city street, inside a plane, a factory work environment, etc. In various embodiments, the acoustic environment codes are stored in register locations within memory 112. In some embodiments, memory 112 includes non-volatile flash memory.

Figure 6:
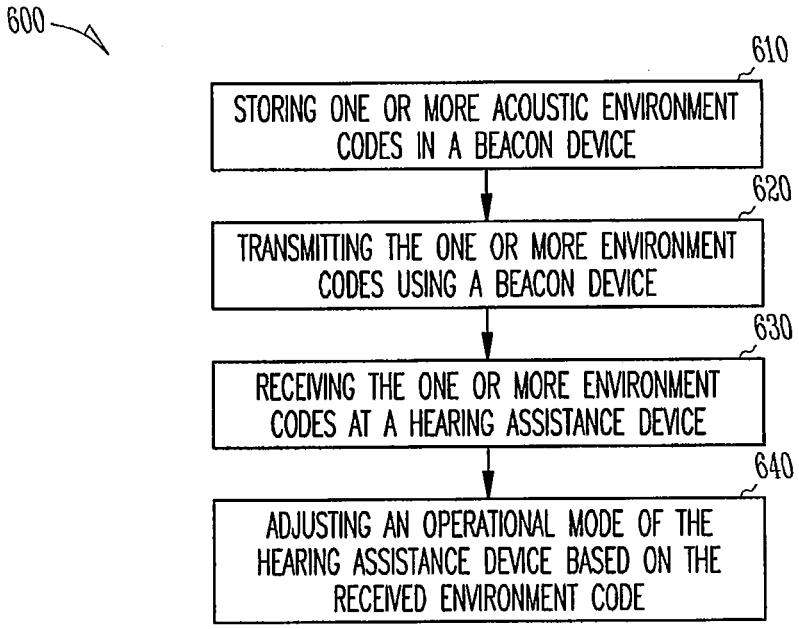
FIG. 6 illustrates a method of providing environment awareness for a hearing assistance device, according to one embodiment of the present subject matter.

FIG. 6 illustrates a flow chart of one embodiment of a method 600 for providing environment awareness in hearing assistance devices. At block 610, method 600 includes storing one or more acoustic environment codes in a beacon device. At block 620, method 600 includes transmitting the one or more environment codes using a beacon device. In various embodiments, transmitting the one or more environment codes comprises transmitting the one or more environment code at uniform intervals.

At block 630, method 600 includes receiving the one or more environment codes at a hearing assistance device. In various embodiments, receiving the one or more environment codes at a hearing assistance device comprises receiving an acoustic environment code when the hearing assistance device enters the particular acoustic environment identified by the acoustic environment code. In various embodiments, receiving the first acoustic environment code comprises receiving the first acoustic environment code when a user having the hearing assistance device enters an automobile, a plane, a railway car or a ship. In various embodiments, the environment code is received when the automobile, plane, railway car or ship begins moving. In various embodiments, acoustic environments can include inside of a car, an empty room, a lecture hall, a room with furniture, open spaces such as in a countryside, a sidewalk of a typical city street, inside a plane, a factory work environment, in a room during vacuuming, watching a television, hearing the radio etc.

At block 640, method 600 includes adjusting an operational mode of the hearing assistance device based on the received environment code. In various embodiments, adjusting the operational mode of the hearing assistance device comprises switching between a first microphone and a second microphone. In various embodiments, switching between a first microphone and a second microphone comprises switching between a directional microphone and an omni-directional microphone. In various embodiments, adjusting the operational mode of the device includes switching from a first omni-directional microphone configuration to a second multi-microphone directional configuration, such as in multi-microphone directional beamforming.

In various embodiments, information is telemetered relating to signals sensed by the one or more sensors on the wireless beacon device. In such designs the information telemetered includes, but is not limited to, sensed signals, and/or statistical information about the sensed signals. Hearing assistance devices receiving such information are programmed to process the received signals to determine an environmental status. In such embodiments, the received information may be used by the hearing assistance system to determine the acoustic environment and/or to at least partially control operation of the hearing assistance device for better listening by the wearer.

The present subject matter aids communication in challenging environments in intelligent ways. It improves the communication experience for hearing assistance users in challenging listening environments such as moving vehicles.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of operating a hearing assistance device worn on or about an ear of a user, the method comprising:

receiving a signal from a cellular telephone representative of a parameter sensed by the cellular telephone, wherein the parameter includes combined information relating to location of the cellular telephone and acceleration of the cellular telephone;

identifying an acoustic environment about the hearing assistance device based on the received signal from the cellular telephone in combination with audio information from the hearing assistance device using a signal processor and without using an output from an accelerometer in the hearing assistance device for identifying the acoustic environment; and adjusting an operational mode of the hearing assistance device using the signal processor based on the identified acoustic environment.

2. The method of claim 1, wherein identifying an acoustic environment includes identifying an inside of a moving vehicle.

3. The method of claim 2, wherein identifying an acoustic environment includes identifying an inside of a moving automobile.

4. The method of claim 2, wherein receiving a signal from a cellular telephone representative of an environmental parameter includes receiving a signal sensed by an accelerometer in the cellular telephone that movement at greater than 5 mph is detected to identify the moving vehicle.

5. The method of claim 1, wherein receiving a signal from a cellular telephone representative of an environmental parameter includes receiving a signal from global positioning system (GPS) in the cellular telephone.

6. The method of claim 3, wherein adjusting an operational mode of the hearing assistance device includes switching to an omni-directional microphone mode.

7. The method of claim 1, wherein identifying the acoustic environment includes using acoustic inputs in combination with the received signal from the cellular telephone.

8. The method of claim 7, wherein receiving the signal includes receiving a Bluetooth™ signal from the cellular telephone.

9. The method of claim 7, wherein receiving the signal includes receiving a CDMA cellular protocol signal from the cellular telephone.

10. The method of claim 7, wherein receiving the signal includes receiving a GSM cellular protocol signal from the cellular telephone.

11. A hearing assistance system including a hearing assistance device worn on or about an ear of a user, the system comprising:

a wireless receiver configured to receive a signal from a cellular telephone including a representation of a sensed parameter related to an acoustic environment about the hearing assistance device, wherein the environmental parameter includes combined information relating to location of the cellular telephone and acceleration of the cellular telephone; and a processor configured to identify the acoustic environment using the received signal from the cellular telephone in combination with audio information from the hearing assistance device without using an output from an accelerometer in the hearing assistance device for identifying the acoustic environment, and to adjust a hearing assistance device parameter based the identified environment.

12. The system of claim 11, wherein the sensed parameter includes a parameter sensed by a global positioning system (GPS).

13. The system of claim 11, wherein the sensed parameter includes a parameter sensed by an accelerometer.

14. The system of claim 11, wherein the hearing assistance device includes a hearing aid.

15. The system of claim 14, wherein the hearing aid includes an in-the-ear (ITE) hearing aid.

16. The system of claim 14, wherein the hearing aid includes a behind-the-ear (BTE) hearing aid.

17. The system of claim 14, wherein the hearing aid includes an in-the-canal (ITC) hearing aid.

18. The system of claim 14, wherein the hearing aid includes a receiver-in-canal (RIC) hearing aid.

19. The system of claim 14, wherein the hearing aid includes a completely-in-the-canal (CIC) hearing aid.

20. The system of claim 14, wherein the hearing aid includes a receiver-in-the-ear (RITE) hearing aid.

* * * * *